US005485261A

United States Patent [19]

Kuroda et al.

[11] Patent Number: 5,485,261

[45] Date of Patent: Jan. 16, 1996

[54] IMAGE FORMING APPARATUS

[75] Inventors: Masayoshi Kuroda, Toyokawa; Masataka Oda, Toyohashi, both of Japan

[73] Assignee: Minolta Co., Ltd., Osaka, Japan

[21] Appl. No.: 279,923

[22] Filed: Jul. 25, 1994

[30] Foreign Application Priority Data

Jul. 30, 1993 [JP] Japan ..... 5-206958

[51] Int. Cl.[6] ..... G03G 21/02

[52] U.S. Cl. ..... 355/319; 355/24

[58] Field of Search ..... 355/319, 318, 355/309, 308, 204, 208, 23, 24, 311

[56] References Cited

U.S. PATENT DOCUMENTS 4,218,130 8/1980 Satomi et al. .
4,607,948 8/1986 Naito ..... 355/24
4,618,242 10/1986 Yamagishi ..... 355/3 FU
4,861,012 8/1989 Shimizu et al. ..... 271/3.1
4,975,738 12/1990 Senma et al. ..... 355/319 X
5,132,720 7/1992 Kioka et al. ..... 355/24

*Primary Examiner*—R. L. Moses
*Attorney, Agent, or Firm*—Willian Brinks Hofer Gilson & Lione

[57] ABSTRACT

There is disclosed an image forming apparatus capable of double-sided or overlay copying at high speed. While a sheet having initially copied a first original document is still being transported to an intermediate tray inside the apparatus, an image forming operation on a second document is started, and one of the initially copied sheets in the intermediate tray starts to be refed therefrom for secondary copying. If the designated number of copying sheets is larger than a predetermined value and when the number of times the image forming operation is performed has exceeded that value, the start of the subsequent image forming operation is delayed by a predetermined time so as to provide the currently transported sheet with an extended distance relative to the preceding sheet. Thus there occurs no interference or feed-related trouble between the sheet which copied the first document and which is being transported to the intermediate tray on the one hand, and the sheet refed from the same tray upon starting of an image forming operation on the second document on the other hand.

12 Claims, 17 Drawing Sheets

SCANNING OPERATION
ON
OFF
SCANNING OF 1ST ORIGINAL
SCANNING OF 2ND ORIGINAL
SCANNING OF 3RD ORIGINAL
$t_1$
$t_2$
$t_1$

TIMING ROLLER
ON
OFF

SENSOR SE11
ON
OFF

PICKUP ROLLER
ON
OFF

REFEEDING PICKUP ROLLER
ON
OFF

SENSOR SE61
ON
OFF

TRAILING EDGE HOLDER
ON
OFF

SCANNING OPERATION
ON
OFF
$t_1$
1 2 3 4 5 6 7 8 9 10
SCANNING OF 1ST ORIGINAL
SCANNING OF 2ND ORIGINAL

TIMING ROLLER

SENSOR SE11

PICKUP ROLLER

REFEEDING PICKUP ROLLER

SENSOR SE61

IMAGE FORMING APPARATUS

BACKGROUND OF THE INVENTION

1. Field of the Invention

The present invention relates to an image forming apparatus capable of recording images on both sides of a recording sheet or recording images in an overlaying manner on the already recorded sheet.

2. Description of the Related Art

There exist copiers capable of double-sided or overlay recording whereby images are copied onto both sides of every sheet or onto one side thereof with images already recorded thereon. This type of double-sided or overlay recording copiers works essentially as follows: a first original document is copied initially onto the predetermined number of recording sheets. All copied sheets are stored temporarily in an intermediate tray. Then a second original document is copied onto the initially copied sheets that are refed from the intermediate tray.

It can be seen that the conventional process of double-side or overlay recording allows copying of the second original document to proceed only after all the initially copied sheets derived from the first document have been stored in the intermediate tray. The waiting period interposed between the two distinct stages of copying inevitably lowers productivity of double-sided or overlay recording, i.e., reduces the number of sheets that may be copied per unit time.

One solution to the above problem is for the double-sided or overlay copying machine to start copying the second document onto the initially copied sheets before these sheets are all placed into the intermediate tray. That is, after the first original document has been scanned for the predetermined number of copying sheets, these sheets should preferably be subjected to copying of the second document before all of them are stored into the intermediate tray. Productivity should be increased if the waiting period following the copying of the first original document were eliminated.

Conventionally, the above solution has been ignored primarily for the following reason: in the putative setup of the solution, even as the initially copied recording sheets are being stored into the intermediate tray, those sheets already placed in that tray should be refed therefrom to the second stage of copying. The incoming and the outgoing sheets within the intermediate tray would interfere with one another, resulting in an incidental dragged-along feed or jamming of sheets.

SUMMARY OF THE INVENTION

It is therefore a general object of the present invention to provide an image forming apparatus capable of double-sided or overlay recording at high speed by controlling the feed timing of recording sheets in accordance with the number of sheets to be recorded.

It is another object of the present invention to provide an image forming apparatus which, when recording sheets with images recorded on one side thereof are to be refed for double-sided or overlay recording, controls the sheet feed timing so as to eliminate interference between the incoming and outgoing sheets inside an intermediate sheet storage part.

These and other objects, features and advantages of the invention will become more apparent upon a reading of the following description and appended drawings.

DETAILED DESCRIPTION OF THE PREFERRED EMBODIMENTS

Figure 1:
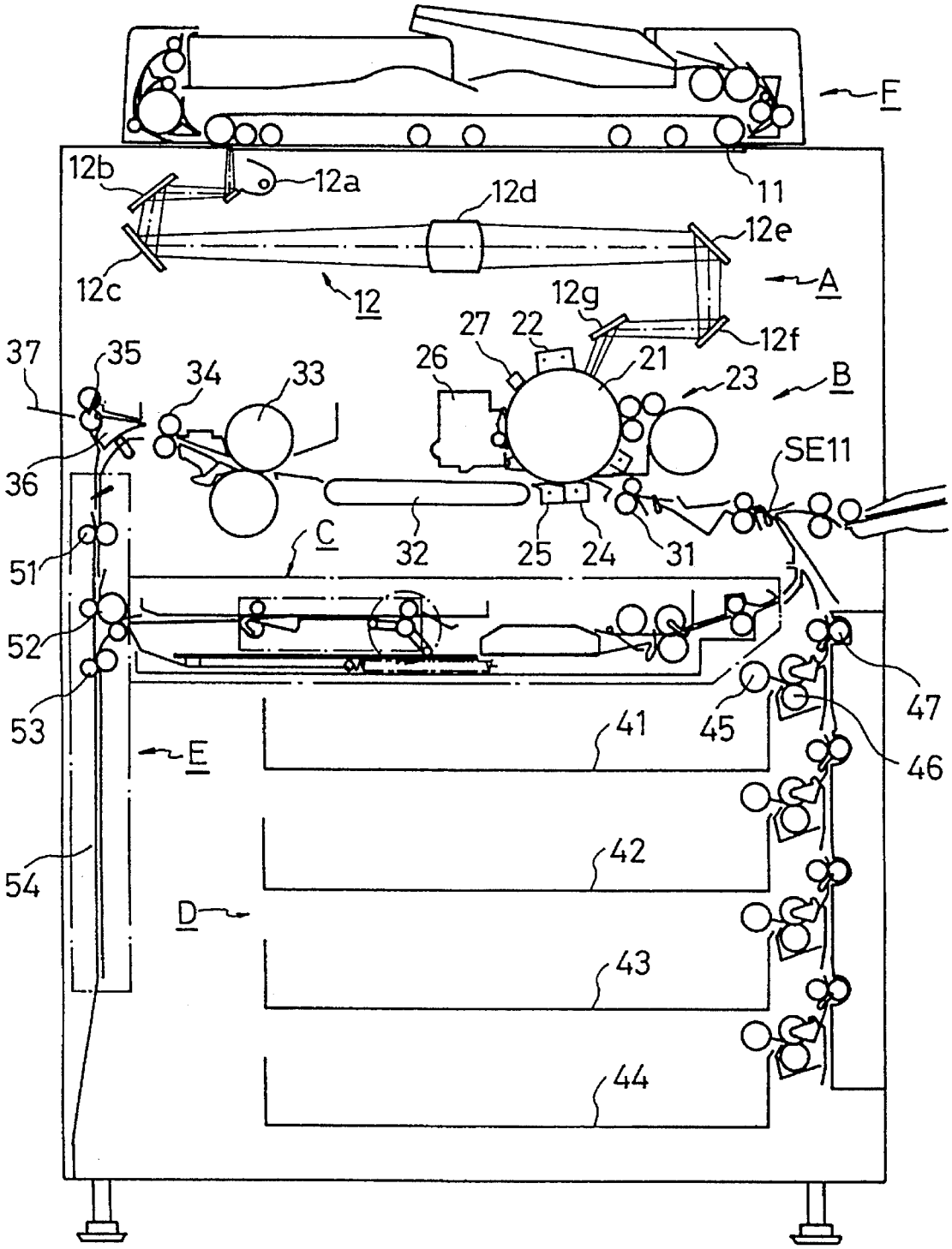
FIG. 1 is a cross-sectional view of an image forming apparatus in a first embodiment according to the present invention.

Preferred embodiments of the present invention will now be described with reference to the accompanying drawings. Referring first to FIG. 1, the constitution of a copier embodying the invention with an intermediate tray is outlined below.

FIG. 1 is a cross-sectional view showing the internal structure of the copier equipped with the intermediate tray arrangement. The copier has, viewed from top to bottom, an exposure-scanning part A, an image forming part B, an intermediate tray part C and a sheet feed part D. On one side of the copier is an inverting part E.

The exposure-scanning part A comprises a document glass 11 located at the top of the copier and an optical scanning system 12 located thereunder. The optical scanning system 12 includes a light source 12*a;* movable mirrors 12*b* and 12*c;* a projection lens 12*d;* and fixed mirrors 12*e,* 12*f* and 12*g*. An original document placed on the glass 11 is scanned and its electrostatic latent image is formed over a photosensitive drum. The mechanism involved is the same as that of conventional image forming apparatuses and will not be detailed further. On top of the document glass 11 is a known automatic document feeder F that feeds documents one by one onto the glass 11 and retrieves each exposed document.

The image forming part B has the photosensitive drum 21 around which are arranged a main charger 22, a developing unit 23, a transfer charger 24, a separation charger 25, a cleaning unit 26 and an eraser lamp 27. Between the developing unit 23 and the transfer charger 24 are interposed timing rollers 31. On the left-hand side of the separation charger 25 are a conveyor belt 32 and a fixing unit 33. Downstream of the fixing unit 33 are transport rollers 34 and discharge rollers 35. Between the transport rollers 34 and the discharge rollers 35 is interposed a transport path switching lever 36 actuated to select one of two transport paths: one for transporting a copying sheet to a discharge tray 37, and the other for transporting the sheet to the intermediate tray part C via the inverting part E.

Using toner, the image-forming part B develops the electrostatic latent image formed by the exposure-scanning part A on the photosensitive drum 21. The developed image is transferred onto a recording sheet fed from the intermediate tray part C or from the sheet feed part D. The mechanism performing these steps is the same as that of known image forming apparatuses and will not be elaborated on further.

The sheet feed part D comprises a plurality of sheet feed cassettes 41 through 44, pickup rollers 45, separation rollers 46, and transport rollers 47, assigned to each of the cassettes. Recording sheets are fed from the selected sheet feed cassette (one of 41–44) to the image-forming part B.

The inverting part E inverts the obverse and reverse sides of each sheet for double-sided recording before the sheet reaches the intermediate tray part C. The inverting part E comprises transport rollers 51, paddle rollers 52, inversion rollers 53 and an inverted sheet storage part 54. In a sheet inverting operation, the inversion rollers 53 are first rotated forward to place the sheet into the inverted sheet storage part 54. Then the inversion rollers 53 are rotated in reverse to transport the sheet, trailing edge first, to the intermediate tray part C.

For overlay recording requiring no inversion of recording sheets, the sheets are transported directly to the intermediate tray part C via the paddle rollers 52. The structure of the inverting part E is the same as that of conventional image forming apparatuses and will not be detailed further.

The intermediate tray part C temporarily stores initially recorded sheets prior to secondary image formation thereon for double-sided or overlay recording. The second image formation, i.e., recording based on the second original document, is carried out on the sheets fed from the intermediate tray part C.

The intermediate tray in conventional copiers stores the total predetermined number of the recording sheets having copied with respect to the first original document, and then lets the sheets be fed out for recording of the second original document. By contrast, the invention provides an image forming apparatus wherein, before the initially recorded sheets derived from the first document are all placed into the intermediate tray, it is possible to start feeding sheets out of the intermediate tray for the process of recording from the second document. The constitution of the arrangements involved is described below.

Figure 2:
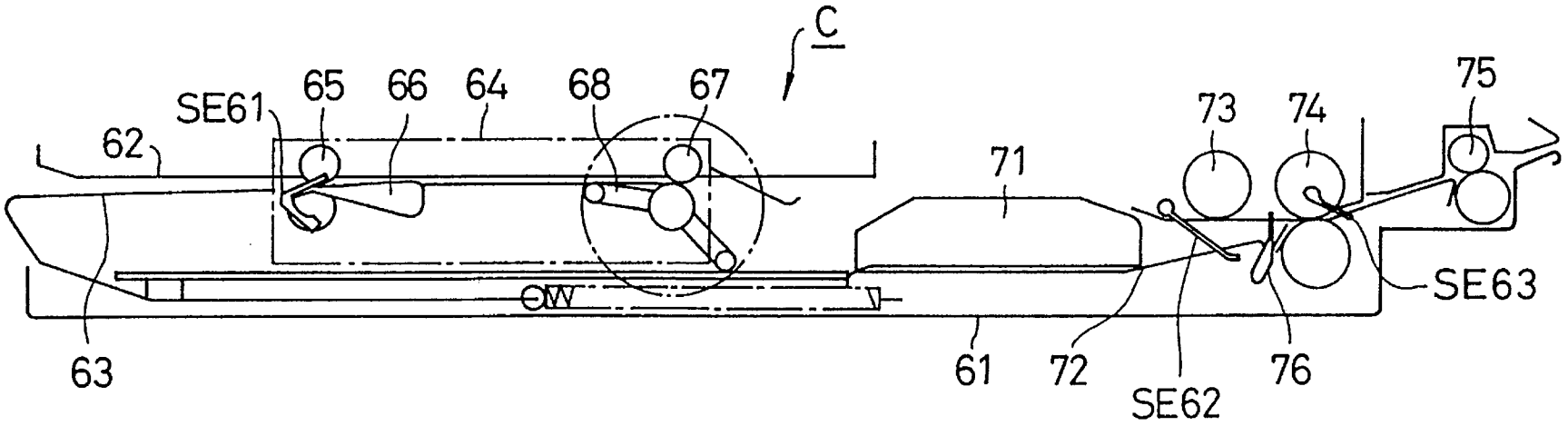
FIG. 2 is a cross-sectional view of an intermediate tray in the first embodiment.

FIG. 2 is a cross-sectional view of the intermediate tray part C. The intermediate tray part C, assembled on a frame 61, has an upper guide 62 and a lower guide 63. The lower guide 63 is moved crosswise by a mechanism, not shown, to be appropriately positioned depending on the recording sheet length in the sheet transport direction. A sheet storage unit 64 has a first storage sensor SE61 that times the operation of a width-aligning plate 71, first storage rollers 65, and a switching pawl 66 furnished on the sheet entry side. On the sheet ejection side, the sheet storage unit 64 has second storage rollers 67 and a trailing edge holder 68.

Recording sheets that are long each in the sheet transport direction are placed into the sheet storage unit 64 via the first storage rollers 65. The switching pawl 66 serves as the guide allowing the first storage rollers 65 to put the sheets into the sheet storage unit 64.

The trailing edge holder 68 works in advanced feed mode, to be described later. In operation, the trailing edge holder 68 holds the trailing edge of each sheet previously transported up to the intermediate tray part C so that the currently transported sheet placed above the preceding sheet will be refed therefrom without causing an incidental dragged-along feed of the sheet below.

Downstream of the sheet storage unit 64 is a sheet storage tray 72 having the width-aligning plate 71 that aligns the width position of transported recording sheets. Further downstream of the sheet storage tray 72 are a pickup roller 73, separation rollers 74, transport rollers 75, a leading edge-aligning plate 76 that prevents inter-sheet sticking by aligning the leading edge positions of sheets, a paper empty sensor SE62 that detects the absence of a recording sheet in the intermediate tray part C, and a refeed sensor SE63 that times the refeed operation.

An image recording operation in advanced feed mode will now be described with reference to FIGS. 1, 2, 3 and 4. The example used involves 10 sheets of recording sheet copying two original documents. It is assumed that each recording sheet is of A4 size and is fed crosswise (i.e., sheets are transported in the direction of their short sides).

Two original documents are loaded in the automatic document feeder F. An operator enters, through a control panel, not shown, the desired sheet size (A4), the magnification of recording, and the number of sheets required (i.e., 10), and presses a print key to designate the start of the recording operation.

The automatic document feeder F sets the first document onto the document glass 11. An appropriate sheet feed cassette is selected (cassette 41 in this example) as per the designated recording sheet size, and a sheet is fed from the cassette. When an intermediate roller preceding sensor SE11 detects the sheet, a scan timing timer, not shown, starts counting time to determine when to start scanning. Upon completion of the counting terminated, the first document starts to be scanned. The electrostatic latent image of the document thus formed over the photosensitive drum 21 is developed by the developing unit 23, whereby a toner image is created.

The sheet so fed is stopped temporarily at the timing rollers 31, and then forwarded to the transfer position in synchronism with the toner image coming to the same position. The sheet on which the toner image has been transferred is subjected to fixing before being placed into the sheet storage tray 72 of the intermediate tray part C. The above steps of operation are repeated until the seventh sheet is placed into the sheet storage tray 72.

When a sheet counter, not shown, indicates the start of recording on the eighth sheet, the intermediate roller preceding sensor SE11 detects the sheet fed from the sheet feed cassette 41 and a delay timer, also not shown, acts to delay the start of scanning by a predetermined period of time. That is, the eighth sheet is fed from the sheet feed cassette 41 up to the timing rollers 31 based on the same timing as those of the first through the seventh sheets, but then the eighth sheet is made to wait longer than its predecessors at the timing rollers 31. The eighth sheet is thus separated from the seventh sheet by the transport distance corresponding to the time delayed by the delay timer.

Figure 3:
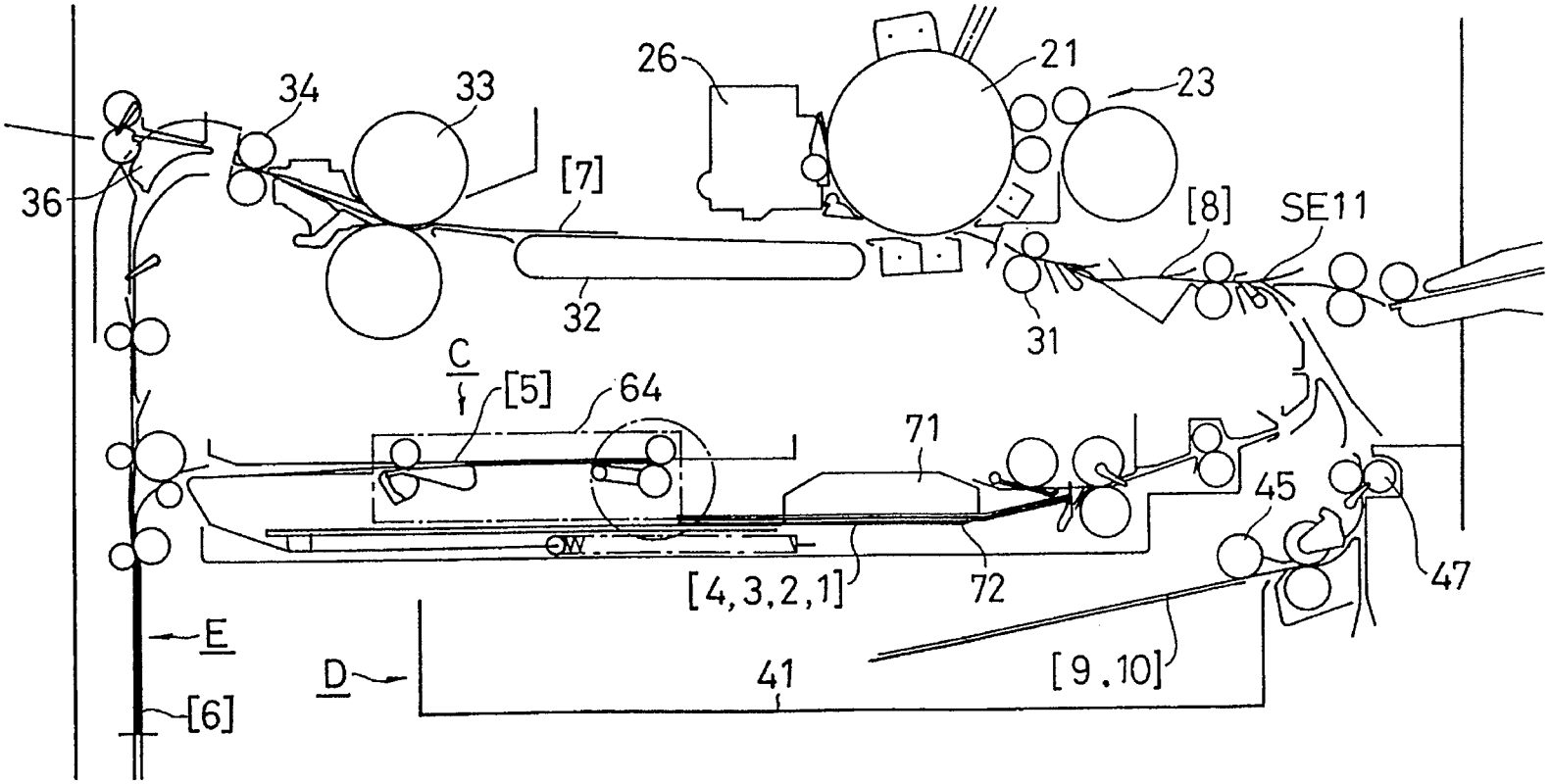
FIG. 3 is a cross-sectional view showing how recording sheets are fed and transported in the first embodiment.

FIG. 3 shows how recording sheets are fed and transported to the intermediate tray part C. As illustrated, the first through fourth sheets (1, 2, 3, 4) are placed in the sheet storage tray 72, the fifth sheet (5) is in the sheet storage unit 64, the sixth sheet (6) in the inverting part E, and the seventh sheet (7) at the fixing unit 33. The eighth sheet (8) is held stationary at the timing rollers 31, and the ninth and tenth sheets (9, 10) are still in the sheet feed cassette 41.

The pickup roller 45 and the transport rollers 47 are driven in synchronism with the timing rollers 31. This arrangement keeps constant the transport distance between sheets from the pickup roller 45 to the timing rollers 31.

When the timing rollers 31 are actuated, the eighth sheet is fed to the transfer position. The sheet on which the toner image has been transferred in that position is subjected to the fixing process by the fixing unit 33, and is transported to the intermediate tray part C.

The ninth and tenth sheets are each fed to the transfer position in the same manner as the eighth sheet. In other words, the transport distance between the eighth and night sheets and that between the ninth and tenth sheets are each equal to the extended transport distance between the seventh and eighth sheets corresponding to the time delayed by the delay timer.

Figure 4:
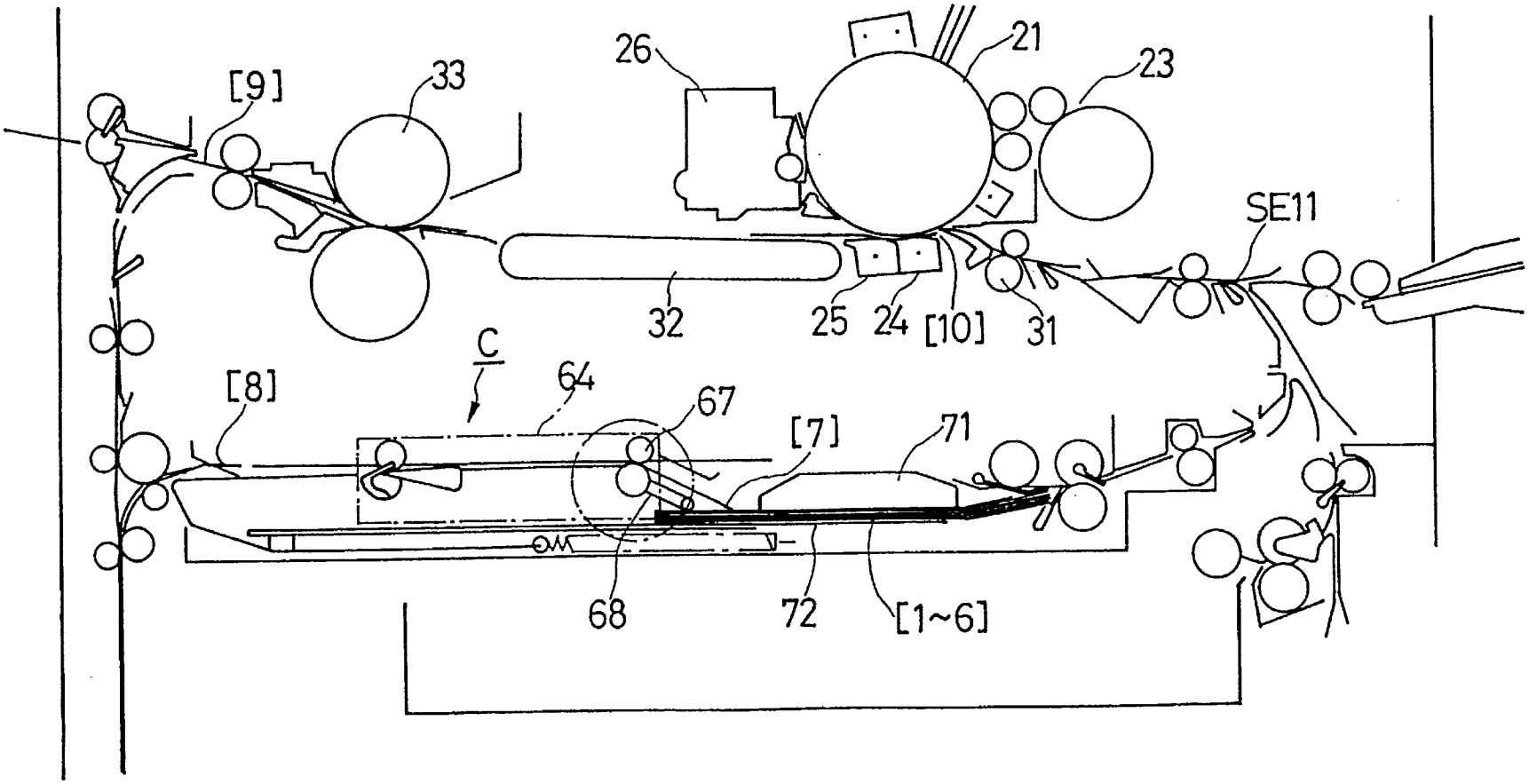
FIG. 4 is another cross-sectional view showing how the recording sheets are fed and transported in the first embodiment.

FIG. 4 is another view depicting how recording sheets are fed and transported in the embodiment. As illustrated, the first through sixth sheets (1–6) are placed in the sheet storage tray 72, the trailing edges of the sheets being held by the trailing edge holder 68. The seventh sheet (7) is transported onto the sixth sheet (6), the trailing edge of the seventh sheet being positioned at the second storage rollers 67. The eighth sheet (8) is sent from the inverting part E to the intermediate tray part C. The ninth sheet (9) is at the fixing unit 33 and the tenth sheet (10) is in the transfer position.

When the tenth sheet is placed in the sheet storage tray 72, the advanced feed mode comes to an end. (This is the mode in which each of the eighth through tenth sheets is fed forward while allowing for an extended transport distance relative to the respectively preceding sheet.)

When scanning of the first original document is ended for image formation on the tenth sheet, the automatic document feeder F is immediately activated to place the second original document onto the document glass 11. At this point, as described, the trailing edges of the first through sixth sheets stacked in the sheet storage tray 72 are held in place by the trailing edge holder 68, and the seventh sheet is placed on the sheet stack (see FIG. 4).

The first sheet on which to copy the second original document is the seventh sheet which, having copied the first document, is fed from the sheet storage tray 72 of the intermediate tray part C. A toner image of the second document is first transferred to and fixed on the seventh sheet. The sheet with the transferred image is then ejected onto the ejection tray 37.

Thereafter, the eighth sheet that copied the first original document is fed as a second sheet to copy the second document; the ninth sheet having copied the first document is fed as a third sheet to copy the second document; and the tenth sheet is fed as a fourth sheet to copy the second document. After this, the first through sixth sheets stacked in the intermediate tray are fed therefrom in a last-in, first-out basis, i.e., the sixth sheet going out first and the first sheet leaving the tray last.

Figure 5:
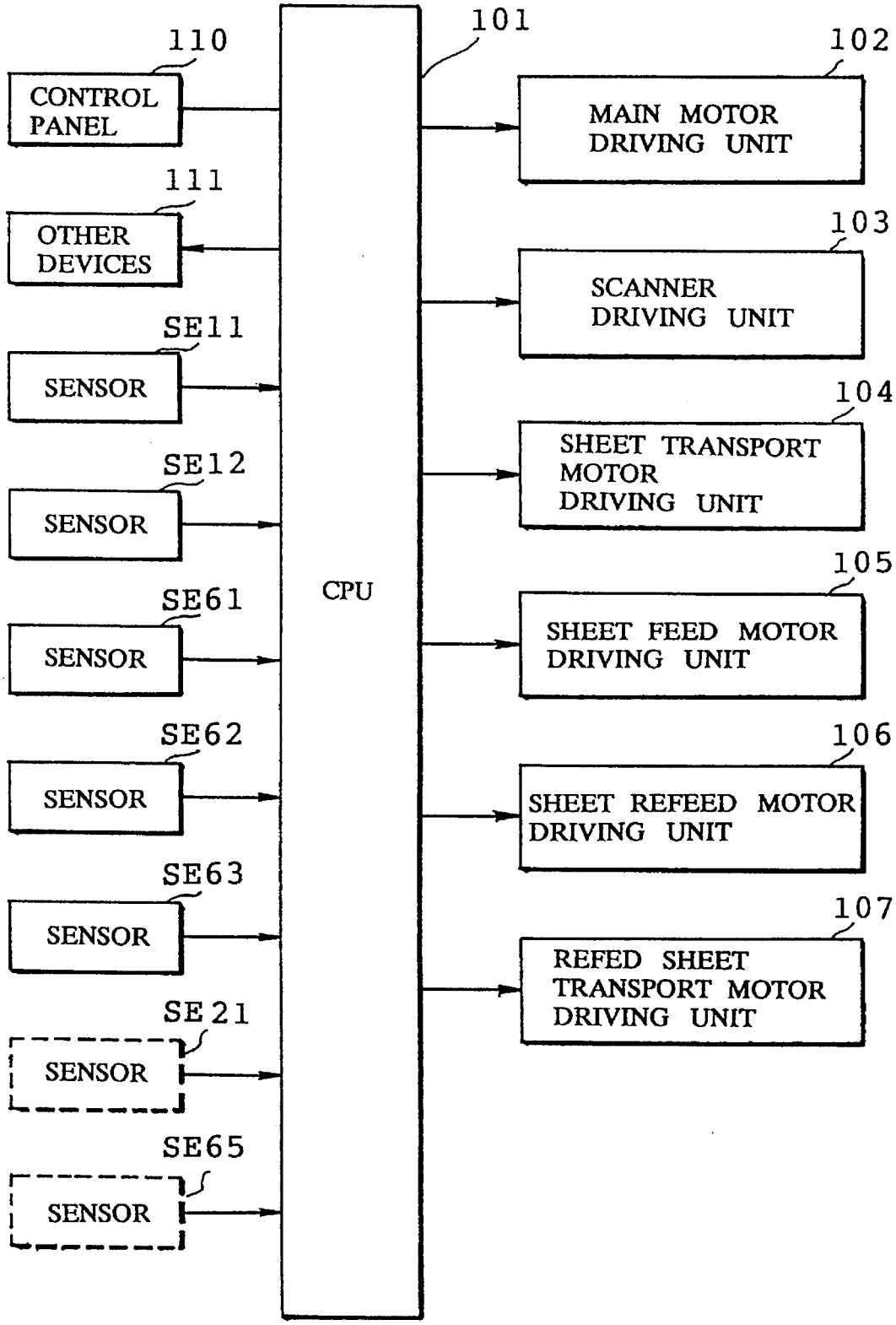
FIG. 5 is a block diagram of a control circuit in the first embodiment.

FIG. 5 is a block diagram of a control circuit of this image forming apparatus in the first embodiment of the invention. The control circuit comprises a CPU 101. The I/O port of the CPU 101 is connected with a main motor driving unit 102, a scanner driving unit 103, a sheet transport motor driving unit 104, a sheet feed motor driving unit 105, a sheet refeed motor driving unit 106, a refed sheet transport motor driving unit 107, a control panel 110, and other devices 111. Also connected to the I/O port are various sensors such as the sensors SE11, SE12, SE61, SE62 and SE63. Sensors SE21 and SE65 indicated by broken line in FIG. 5 are to be included in the second embodiment, to be described later, but not in the first embodiment.

FIGS. 6 through 9 are flowcharts describing the workings of the control circuit.

Figure 6:
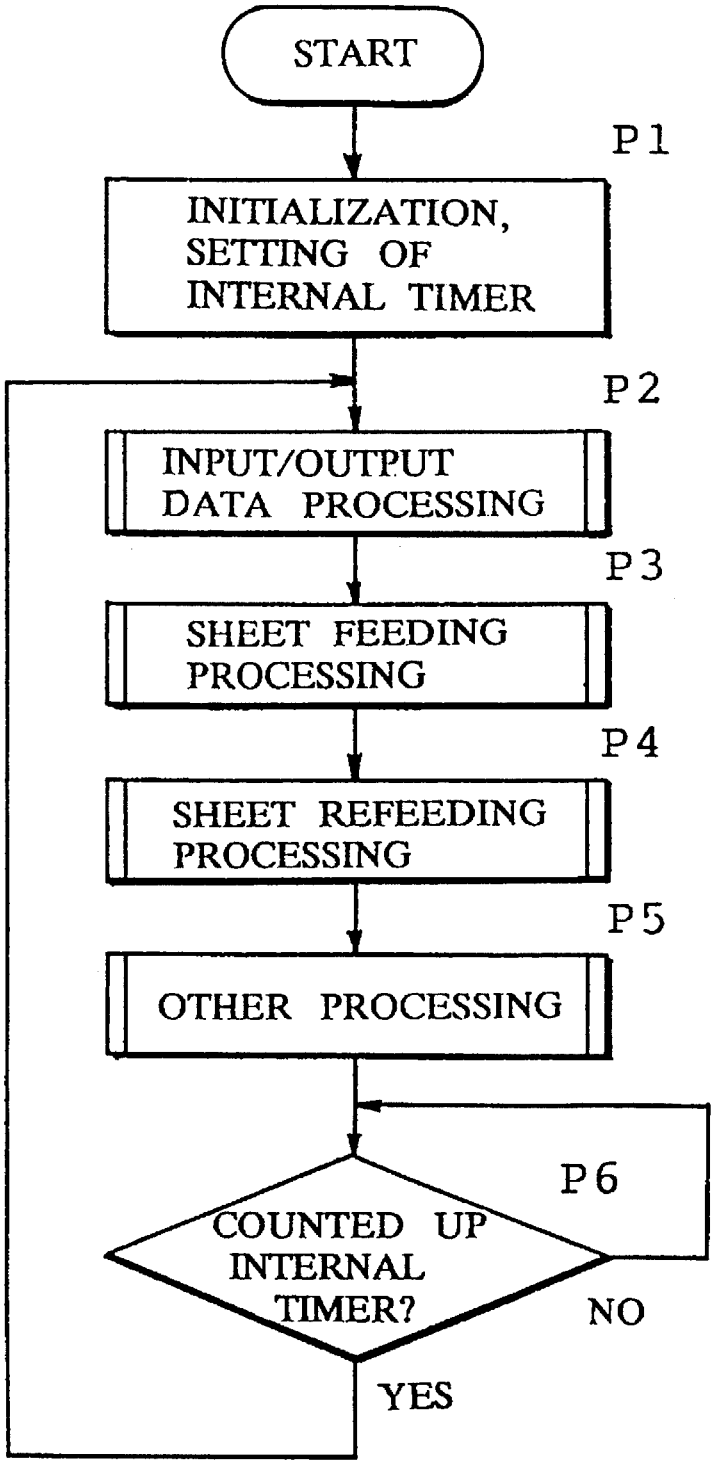
FIG. 6 is a flowchart outlining the operation of the control circuit.

FIG. 6 is a flowchart showing how the main routine of the control circuit works. Applying power starts the control operation. Various control objects and flags are initialized, an internal timer that defines the processing time of a single routine run is set, and the timer is started (step P1). The size of recording sheet, the required number of recording sheets, the magnification of recording, recording density, and the option of one-sided/double-sided/overlay recording are input through the keys of the control panel, not shown. The input signals resulting from these entries, input signals from various sensors, and output signals to various display units, not shown, are processed (step P2). Sheets are fed from a sheet feed cassette for initial recording (step P3). Initially recorded sheets are then refed from the intermediate tray for secondary recording (step P4). Other necessary processes such as image formation are also carried out (step P5). The completion of the counting on the internal timer is awaited (step P6). With the counting completed, step P2 is reached again.

Figure 7:
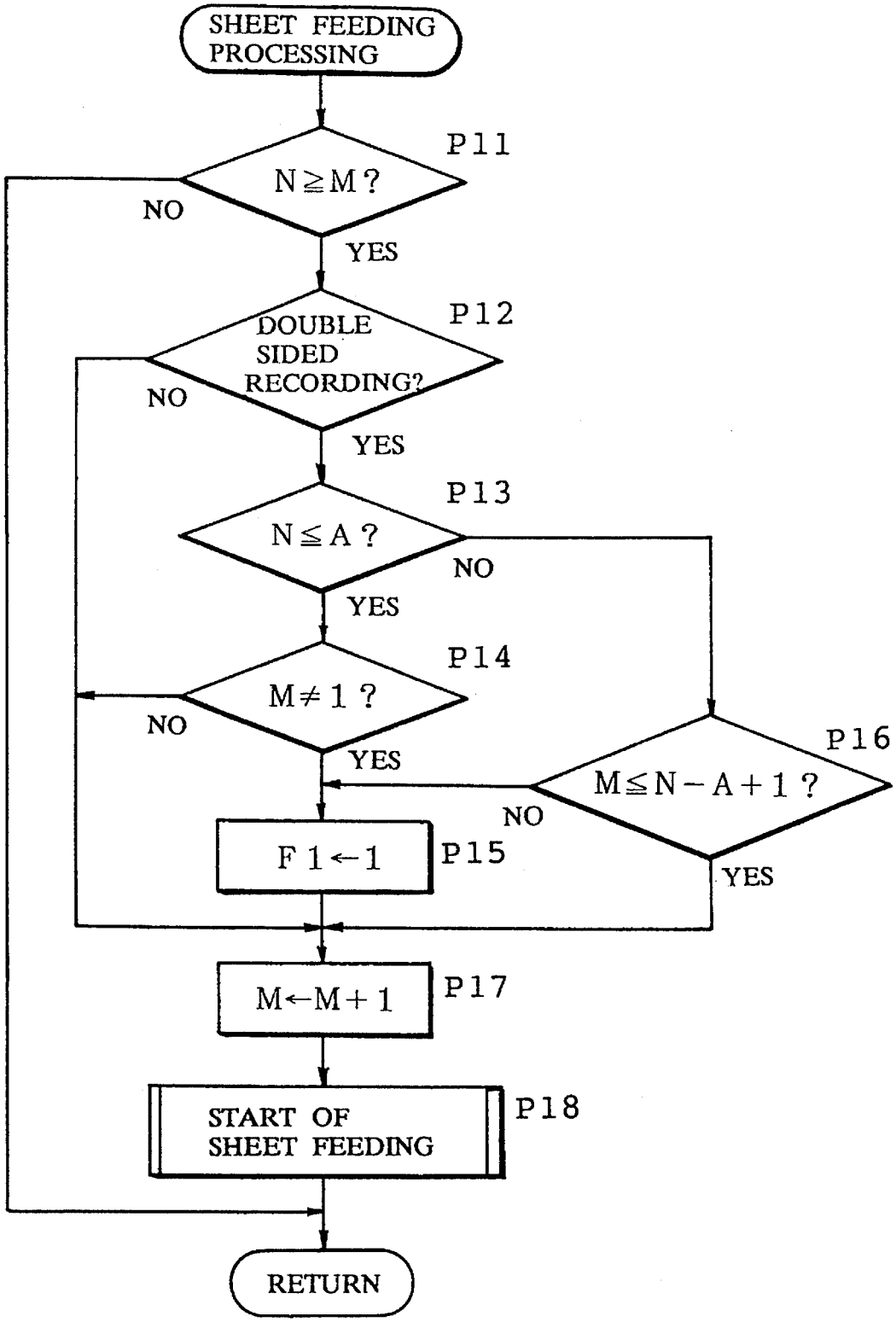
FIG. 7 is a flowchart detailing a sheet feed process in the first embodiment.

FIG. 7 is a flowchart detailing the sheet feed process in step P3 of FIG. 6. First, the designated number of recording sheets N is compared with the value M of a sheet feed counter counting the number of sheets fed from the sheet feed cassette (step P11). If the counter value M is found to have reached the designated number of sheets N, control is returned to the main routine.

A check is made to see whether one-sided or double-sided recording (the latter including overlay recording) has been selected (step P12). For one-sided recording, step P17 is reached immediately, the sheet feed counter is incremented by 1 (step P17), and the sheet feed operation is started. For double-sided (or overlay) recording, a check is made to see if the designated number of recording sheets N exceeds a predetermined value A (step P13). The value A denotes the number of sheets to be refed immediately from the sheet storage tray 72 after entry therein without getting stacked in the same tray.

If $N \leqq A$ in step P13, the copied sheet is not stacked in the sheet storage tray 72 but refed therefrom immediately after entry therein. A check is then made to see if the value M of the sheet feed counter is 1 (step P14). If $M \neq 1$ in step P14, a flag F1 is set (step 15), and the sheet feed counter is incremented by 1 (step P17). When the return of the scanner is verified, the next recording sheet is fed (step P18).

That is, if $N \leqq A$, the copied sheet is not stacked but refed immediately. This requires that, with the first sheet starting to be fed without delay, the second and subsequent sheets be delayed appropriately so as not to hamper the refeed operation. That in turn requires setting the flag F1.

If $N > A$ in step P13, the copied sheet is stacked in the sheet storage tray 72. In that case, a check is made to see if the value M of the sheet feed counter is M≦(N−A+1) (step P16). If M>(N−A+1), then the flag F1 is set (step P15), and step P17 is reached.

That is, when N>A, there exist recording sheets to be stacked. Then as many sheets as the number N minus the predetermined value A (N−A) are stacked in the sheet feed tray 72. When the number of sheets yet to be fed has reached A, i.e., when M>(N−A+1), the flag F1 is set and a sheet feed timing of the sheet number (N−A+2) is delayed in such a manner as to avoid the disturbance of refeed operation of the sheet number (N−A+1).

The value A is determined in advance based on the constitution of the apparatus, as follows: illustratively, A=4 if the desired size of recording paper sheets is A4, for crosswise feed (i.e., sheets are transported in the direction of their short sides) at a recording magnification of 1.0. Alternatively, A=3 if the desired size of recording paper sheets is A3, for lengthwise feed (i.e., sheets are transported in the direction of their long sides) at a recording magnification of 1.0.

The flag F1 is a flag that is set to delay the timing of forwarding the subsequent sheet refed from the intermediate tray part C toward the photosensitive drum. The delay is intended to prevent interference between the sheet refed from the intermediate tray part C and the sheet being transported toward that part C.

Figure 8:
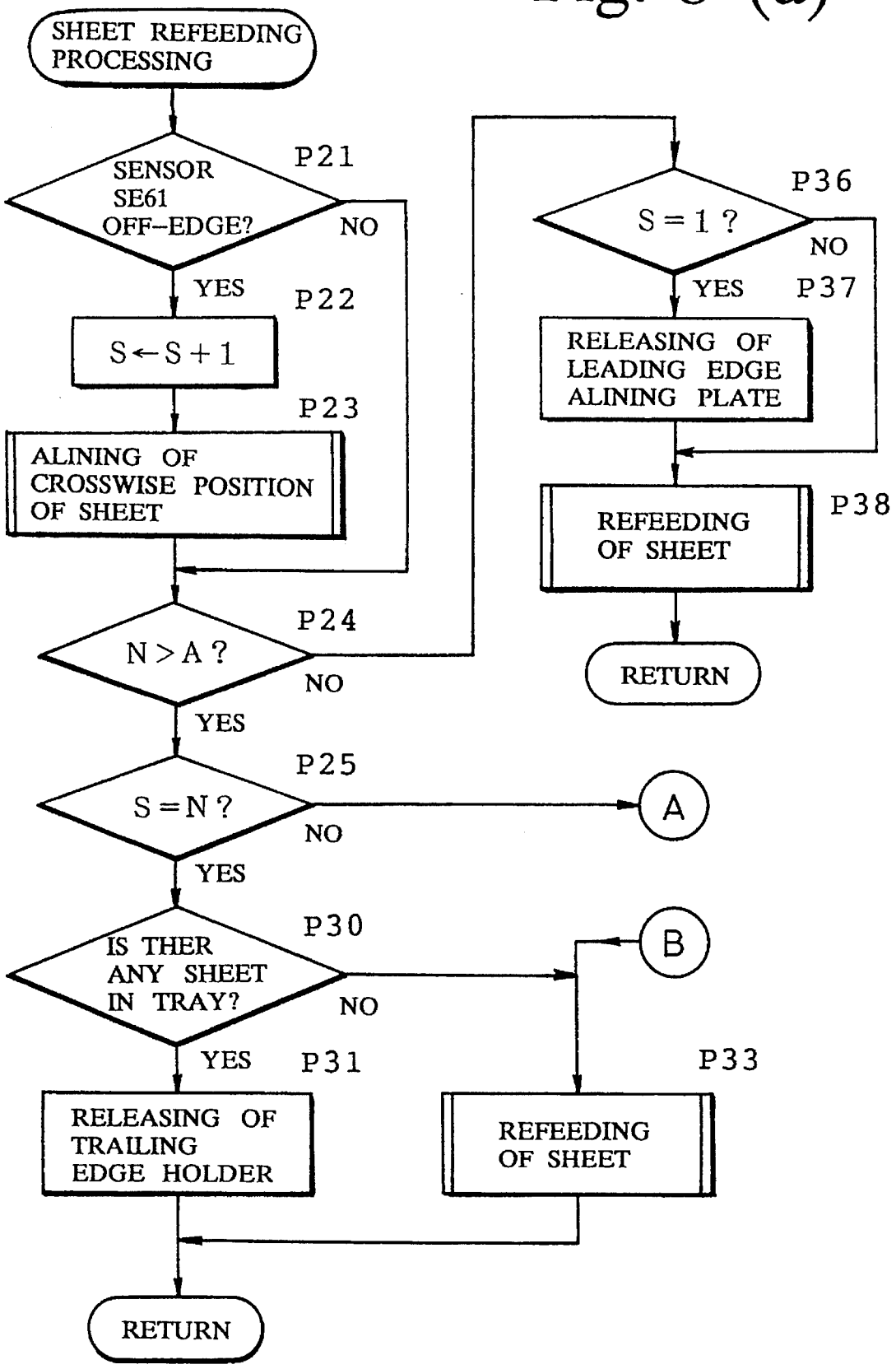
FIG. 8(*a*) and FIG. 8(*b*) are flowcharts detailing a sheet refeed process in the first embodiment.
Figure 8:
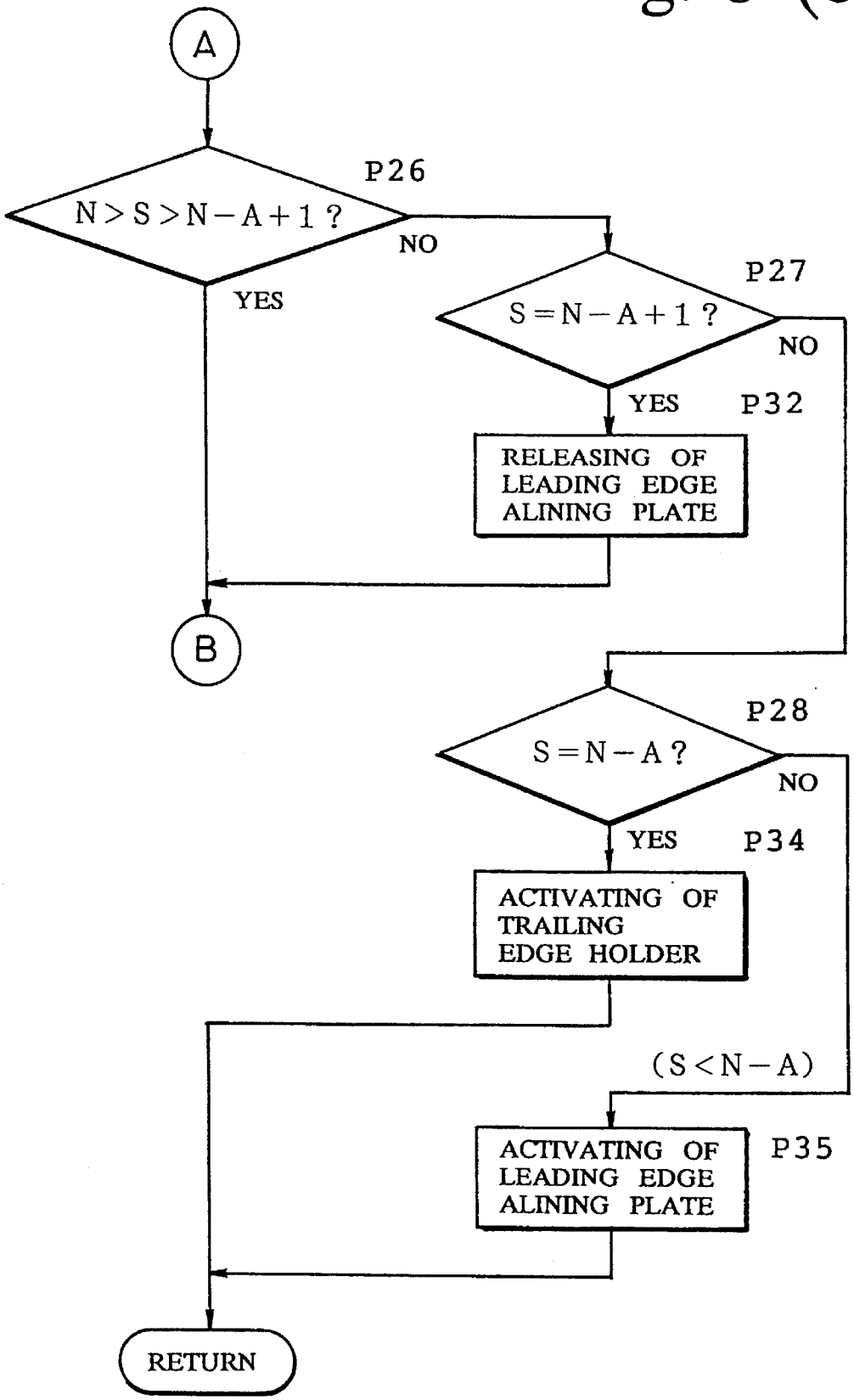

FIG. 8(*a*) and FIG. 8(*b*) are flowcharts detailing the sheet refeed process in step P4 of the routine of FIG. 6. First, a check is made by the first storage sensor SE61 of the intermediate tray part C to see if a sheet has been transported into the sheet storage tray 72 (by detection of an off-edge state) (step P21). If the sheet is found to have been transported into the sheet storage tray 72, a sheet storage counter counting the number of sheets stored is incremented by 1 (step P22). The width-aligning plate 71 then aligns the crosswise position of the recording sheet (step P23).

A check is made to see if the designated number of sheets N is larger than the predetermined value A (step P24). If N>A, control is passed on to step P25 and subsequent steps; if N≦A, control is transferred to step P36 and subsequent steps.

If N>A in step P24, the value S of the sheet storage counter, the designated number of sheets N, and the predetermined value A are compared and checked for relative magnitude therebetween (steps P25, P26, P27 and P28).

If S=N in step P25, i.e., if the number of sheets S in the sheet storage tray 72 is equal to the designated number of sheets N, that connotes the completion of one-sided recording on all sheets required. A check is then made to see if there remains any sheet in the sheet storage tray 72 (step P30). The absence of any sheet in the sheet storage tray 72 denotes the completion of the sheet refeed process. In that case, the trailing edge holder 68 is released (step P31), and control is returned to the main routine. If any sheet remains inside the sheet storage tray 72, a sheet refeed operation is carried out (step P33).

If N>S>(N−A+1) in step P26, the sheets stacked in the sheet storage tray 72 are not fed. Instead, the sheet transported anew to the intermediate tray part C is refed (step P33).

If S=(N−A+1) in step P27, the constraint exerted by the edge-aligning plate 76 on the sheets stacked in the sheet storage tray 72 is released. Then the sheet transported anew to the intermediate tray part C is refed (steps P32 and P33).

If S=(N−A) in step P28, the trailing edge holder 68 is activated to hold the trailing edges of the already stacked sheets in the sheet storage tray 72. This prepares for refeeding the sheet that is transported anew to the intermediate tray part C (step P34). Control is then returned to the main routine.

If S≠(N−A) in step P28, i.e., if S<(N−A), the leading edge of the sheet transported into the sheet storage tray 72 is aligned by the leading edge-aligning plate 76 to let the sheet stack in the tray 72 (step P35). Then the main routine is reached again.

If N≦A in step P24, there is no need to stack the sheet in the sheet storage unit 64. In that case, a check is made to see if S=1, i.e., if one sheet alone is stored in the sheet storage tray 72 (step P36). If S=1, the constraint by the leading edge-aligning plate 76 is released (step P37), and the sheet is refed (step P38). If S≠1, the sheet is refed immediately (step P38).

Figure 9:
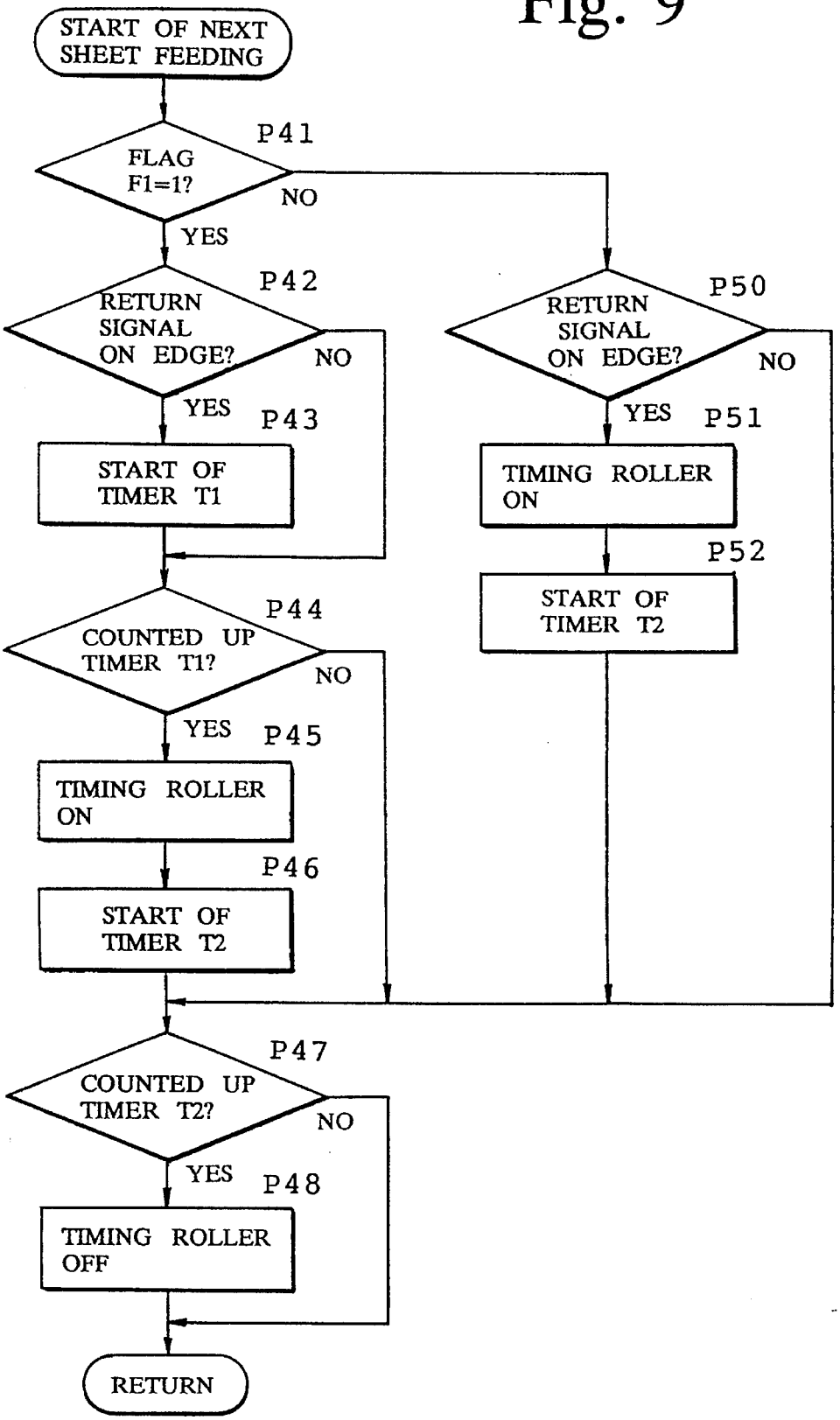
FIG. 9 is a flowchart detailing a sheet feed start process in the first embodiment.

FIG. 9 is a flowchart detailing the sheet feed start process in step P18 of the sheet feed processing routine in FIG. 7. A check is first made to see if the flag F1 set in step P15 of the sheet feed processing routine of FIG. 7 is 1 (step P41). If the flag F1 is found to be set to 1, the process of delaying the sheet feed timing is carried out.

A timer T1 is set upon output of an on-edge return signal denoting the end of scanning by the scanner, and the timer T1 is started to count (steps P42 and P43). A check is made to see if the counting by the timer T1 has ended (step P44). If the counting is found to have ended, the timing rollers 31 are activated to start feeding the sheet (step P45). A timer T2 that defines a timing roller-off time is set, and the counting of the timer T2 is started (step P46).

A check is made to see if the counting by the timer T2 has ended (step P47). If the counting is found to have ended, the timing rollers 31 are deactivated (step P48), and control is returned to the main routine.

If the flag F1 is not found to be set to 1 in step P41, the process of delaying the sheet feed timing is not carried out. Instead, upon completion of scanning by the scanner (step P50), the timing rollers 31 are activated immediately to start feeding the sheet (step P51). The timer T2 that defines a timing roller-off time is set, and the counting of the timer T2 is started (step P52). Then step P47 is reached again.

Figures 10A, 10B, 10C, 10D, 10E, 10F, 10G:
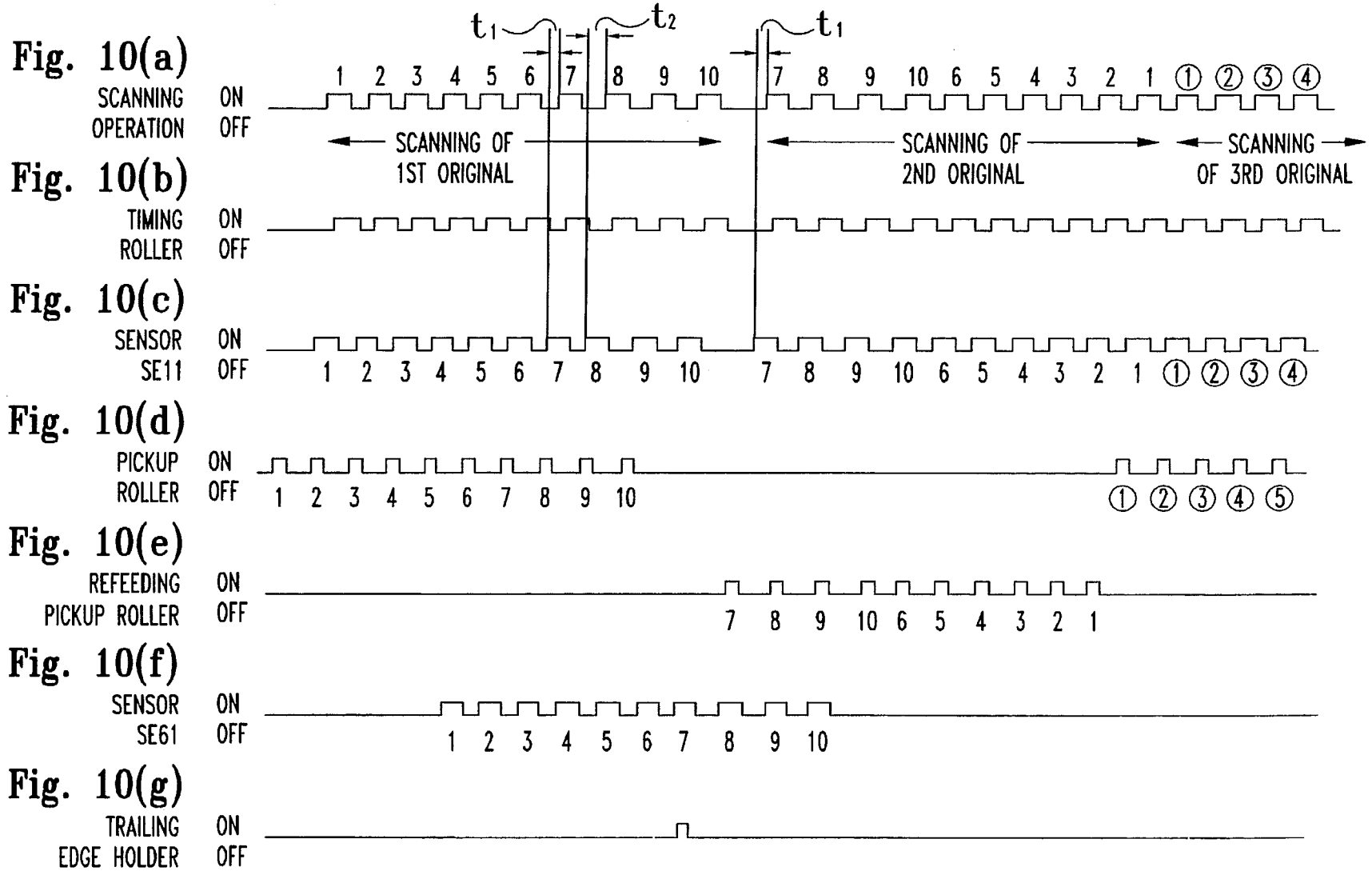
FIGS. 10(*a*)–10(*g*) illustrate a timing chart showing sheet feed timings in advanced feed mode.

FIGS. 10(*a*)–10(*g*) illustrate a timing chart showing feed timings for sheets in advanced feed mode. With this example, the designated number of sheets N is illustratively 10. The timing for operating the timing rollers 31 to feed sheets to the photosensitive drum 21 is normal for the formation of images on the first through seventh sheets. For the eighth and subsequent sheets, the timing is delayed to be longer than that for the first through seventh sheets. That is, for each of the first through seventh sheets, scanning is started after a lapse of a first predetermined time t1 (e.g., 280 ms) after the intermediate roller preceding sensor SE11 has detected the leading edge of each sheet. For the eighth through tenth sheets, scanning is started after a lapse of a second predetermined time t2 (e.g., 480 ms) after the intermediate roller preceding sensor SE11 has detected the leading edge of each sheet.

The arrangement above makes it possible for each of the eighth and subsequent sheets to have an extended distance relative to the preceding sheet in the sheet transport direction as the current sheet is arriving at the intermediate tray part C. When the seventh sheet is stored in the intermediate tray part C, that sheet is refed therefrom after a predetermined period of time as a first sheet to copy the second original document. Scanning of the second document is then started.

After this, the eighth through the tenth sheets that copied the first original document are each refed earlier than the rest to copy the second document. With the eighth through the tenth sheets refed, the first through the sixth sheets that copied the first document and were stacked in the intermediate tray are then refed therefrom on a last-in, first-out basis, i.e., the sixth sheet first and the first sheet last.

In copying the second original document, scanning of the document is always started after a lapse of the first predetermined time t1 (e.g., 280 ms) after the intermediate roller preceding sensor SE11 has detected the leading edge of the refed sheet. It should be noted that the seventh through the tenth sheets are each refed while being provided with an extended transport distance relative to the preceding sheet.

Figures 11A, 11B, 11C, 11D, 11E, 11F:
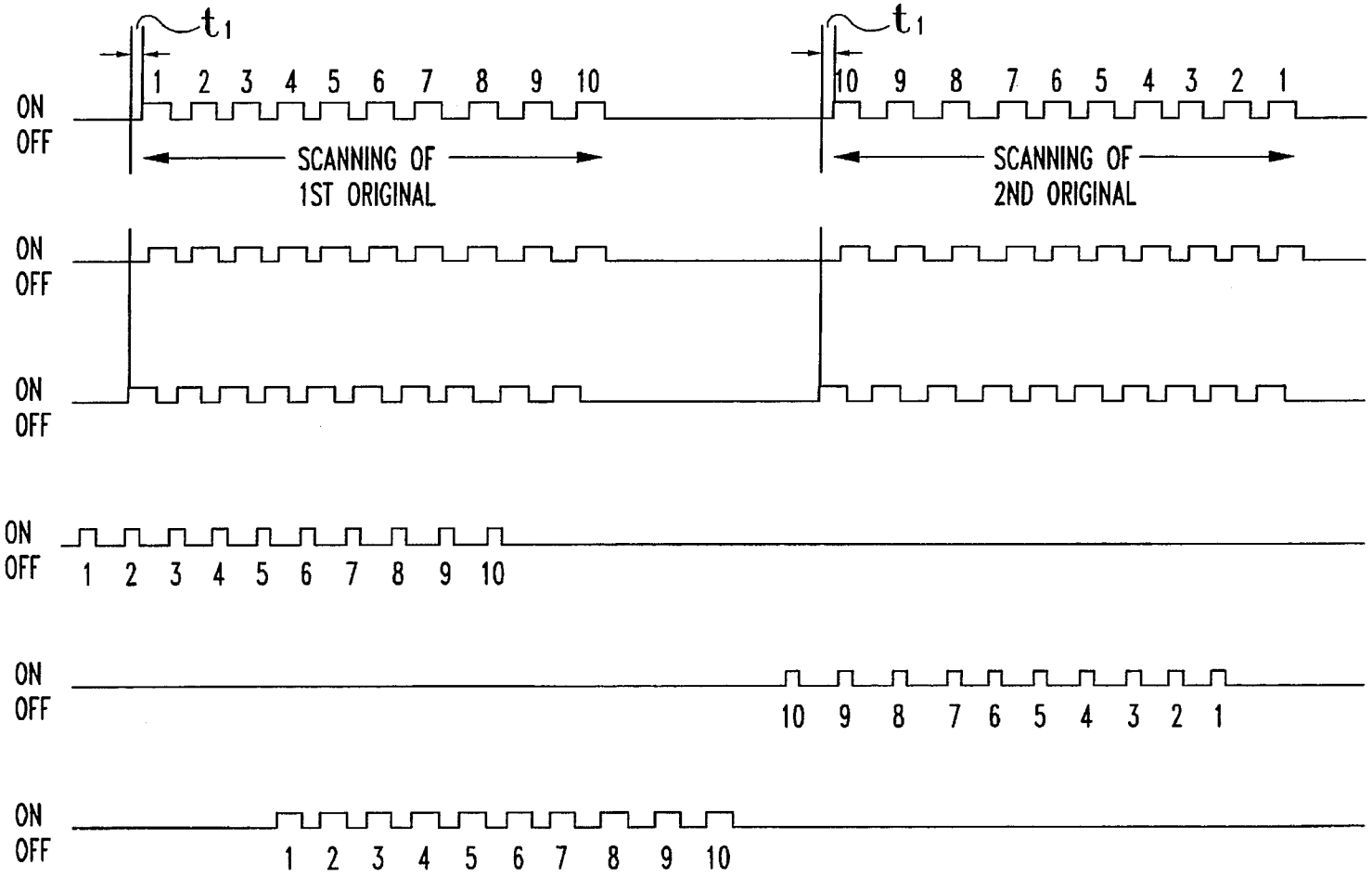
FIGS. 11(*a*)–11(*f*) illustrate a timing chart showing sheet feed timings in normal mode.

FIGS. 11(*a*)–11(*f*) illustrate a timing chart depicting feed timings for sheets in normal mode. In this example, after the image forming operation regarding the first document has ended and all copied sheets have been placed in the intermediate tray part C, an image forming operation regarding the second document is started. Scanning of the second document is always started after a lapse of the first predetermined time t1 (e.g., 280 ms) after the intermediate roller preceding sensor SE11 has detected the leading edge of each refed sheet. It can be seen from the timing chart that it takes longer in normal mode to form images for double-sided or overlay recording than in advanced feed mode.

The second embodiment of the invention will now be described. The second embodiment differs from the first in the following points: as stated, the primary object of the present invention is to solve the problem of overlapping interference between the trailing edge of each refed sheet from the intermediate tray part C and the leading edge of the sheet transported anew to the same tray part C. In solving the problem, the first embodiment described above utilizes procedures to delay the timings of scan initiation and of sheet feed to the photosensitive drum 21 using the timing rollers 31. The delayed start of scanning and the delayed timing of sheet feed operation combine to extend the transport distance of each sheet transported to the intermediate tray part C relative to the preceding sheet, whereby the interference is avoided.

Alternatively, the second embodiment temporarily stops each paper sheet midway in its transport path leading to the intermediate tray part C. This is intended to extend the distance of each sheet relative to the preceding sheet while the current sheet is being transported toward the intermediate tray part C.

Figure 12:
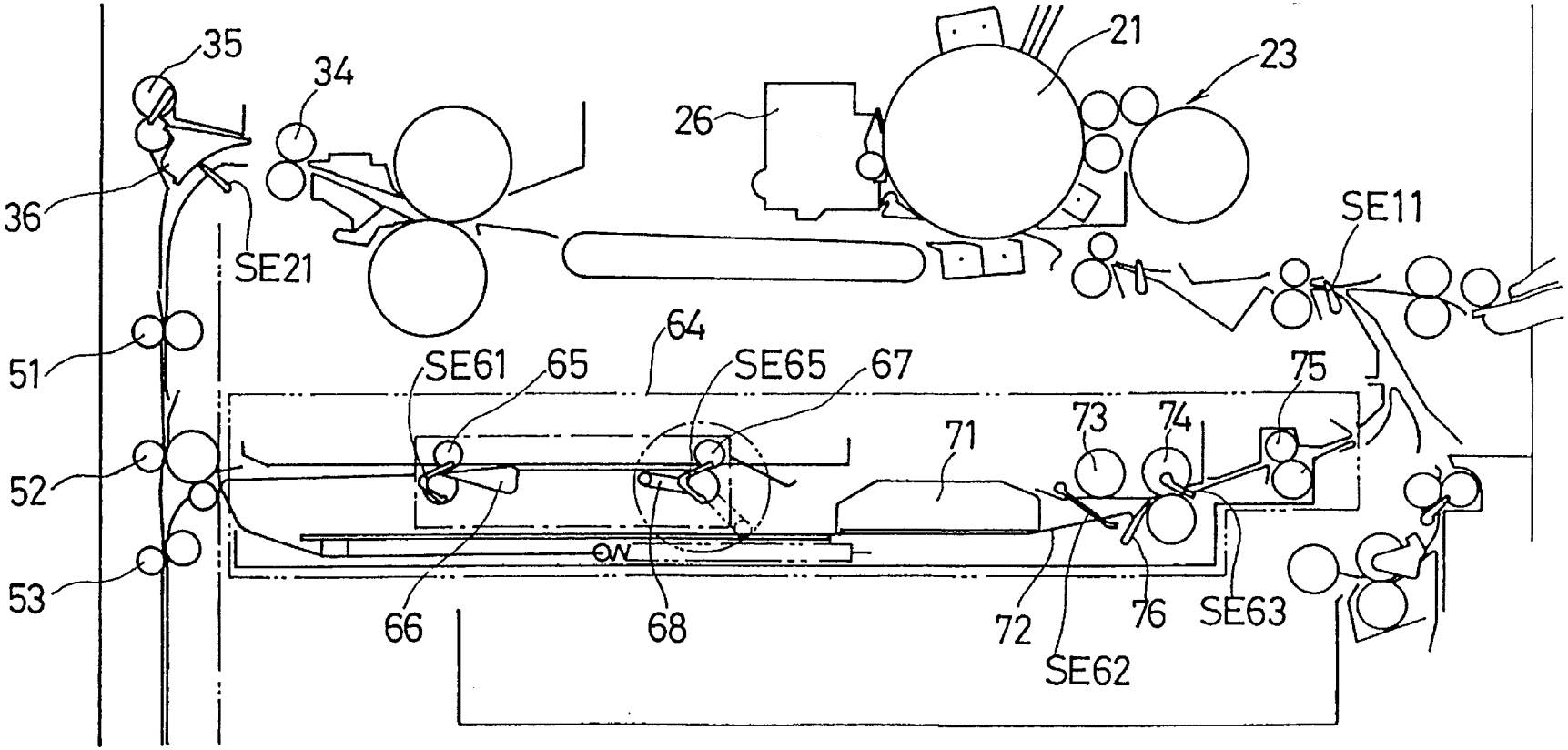
FIG. 12 is a cross-sectional view illustrating an intermediate tray and its related parts in a second embodiment according to the invention.

The second embodiment is similar in construction to the first embodiment except for a slight structural difference in the intermediate tray part C. FIG. 12 is a cross-sectional view illustrating the intermediate tray part C and its related parts of the second embodiment. As illustrated, the difference from the first embodiment is that a second storage sensor SE65 is added to the sheet storage unit 64 in the second embodiment.

The second embodiment stops midway each sheet on its way to the intermediate tray part C when that sheet is detected by an ejection preceding sensor SE21. In this arrangement, the rollers that stop the transport of the sheet in accordance with a detection signal from the ejection preceding sensor SE21 are constituted by the transport rollers 51, paddle rollers 52 and inversion rollers 53, as well as by the first and second storage rollers 65 and 67 inside the intermediate tray part C, as shown in FIG. 12.

The control circuit of the second embodiment is the same as that of the first embodiment in FIG. 5, except that the former includes the ejection preceding sensor SE21 and the second storage sensor SE65.

How the second embodiment is controlled by its control circuit will now be described with reference to the flowcharts of FIGS. 13 through 15. The main routine in the second embodiment is identical to that in the first embodiment shown in FIG. 6 and will not be detailed further.

Figure 13:
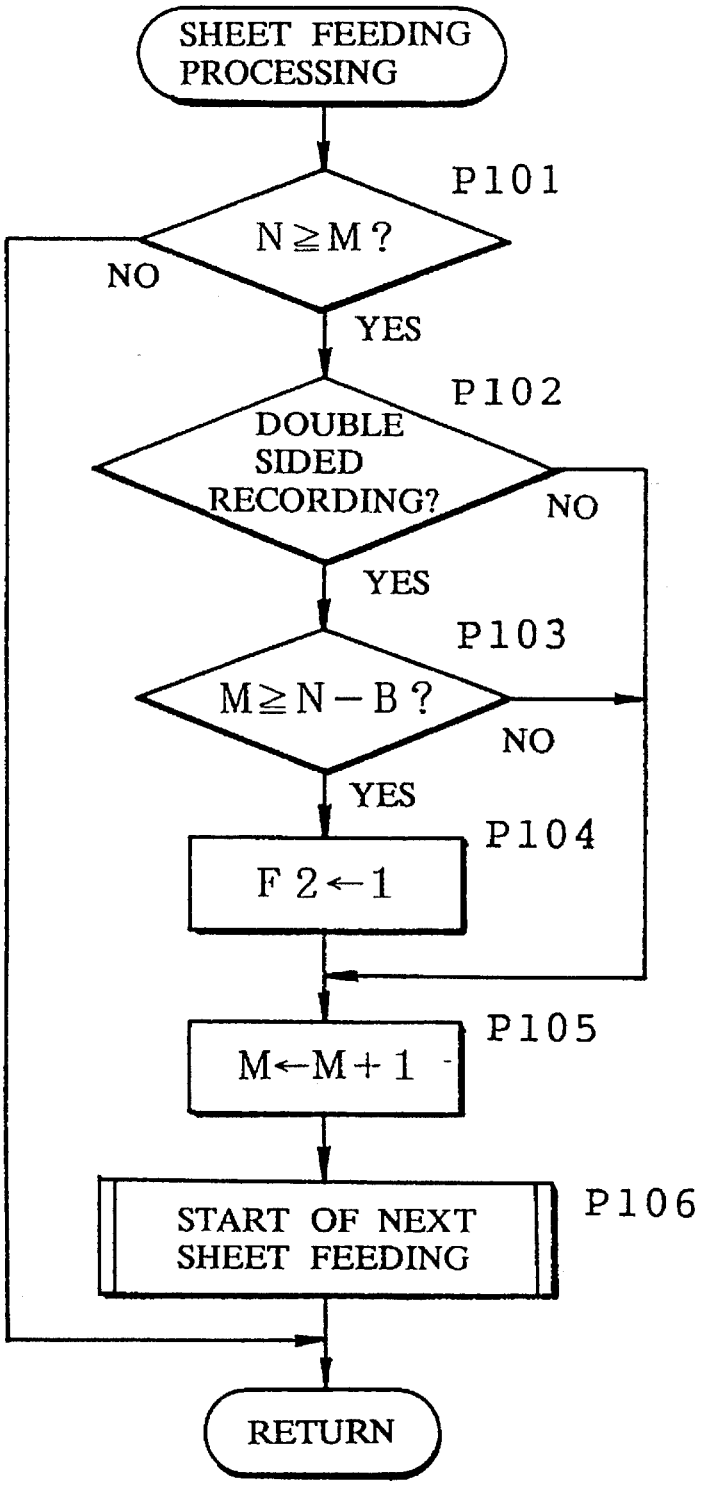
FIG. 13 is a flowchart detailing a sheet feed process in the second embodiment.

FIG. 13 is a flowchart detailing the sheet feed process in step P3 of the routine in FIG. 6. First, a check is made to see if the designated number of recording sheets N is larger than the value M of the sheet feed counter counting the number of sheets fed from a sheet feed cassette (step P101). If the value M of the sheet feed counter is found to have reached the designated number N of sheets, control is returned to the main routine.

A check is then made to see whether single-sided or double-sided recording has been selected (step P102). For single-sided recording, step P105 is reached immediately, the value M of the sheet feed counter is incremented by 1 (step P105), and the sheet feed operation is started (step P106). For double-sided (or overlay) recording, a check is made to see if the value M of the sheet feed counter is larger than the designated number N of sheets minus a predetermined value B (i.e., if $M \leqq N-B$) (step P103). The value B is determined in advance as follows: illustratively, B=2 if the desired size of recording sheets is A4, for crosswise feed (i.e., sheets are transported in the direction of their short sides) at a recording magnification of 1.0.

If $M \leqq N-B$ in step P103, a flag F2 is set (step P104), the value M of the sheet feed counter is incremented by 1 (step P105), and the next sheet is fed (step P106) upon verification of the return of the scanner. If $M<N-B$, step P105 is reached immediately. The flag F2 is a flag that specifies a temporary stop of the sheet being transported toward the intermediate tray in order to prevent interference with the sheet being refed from the same tray.

Figure 14:
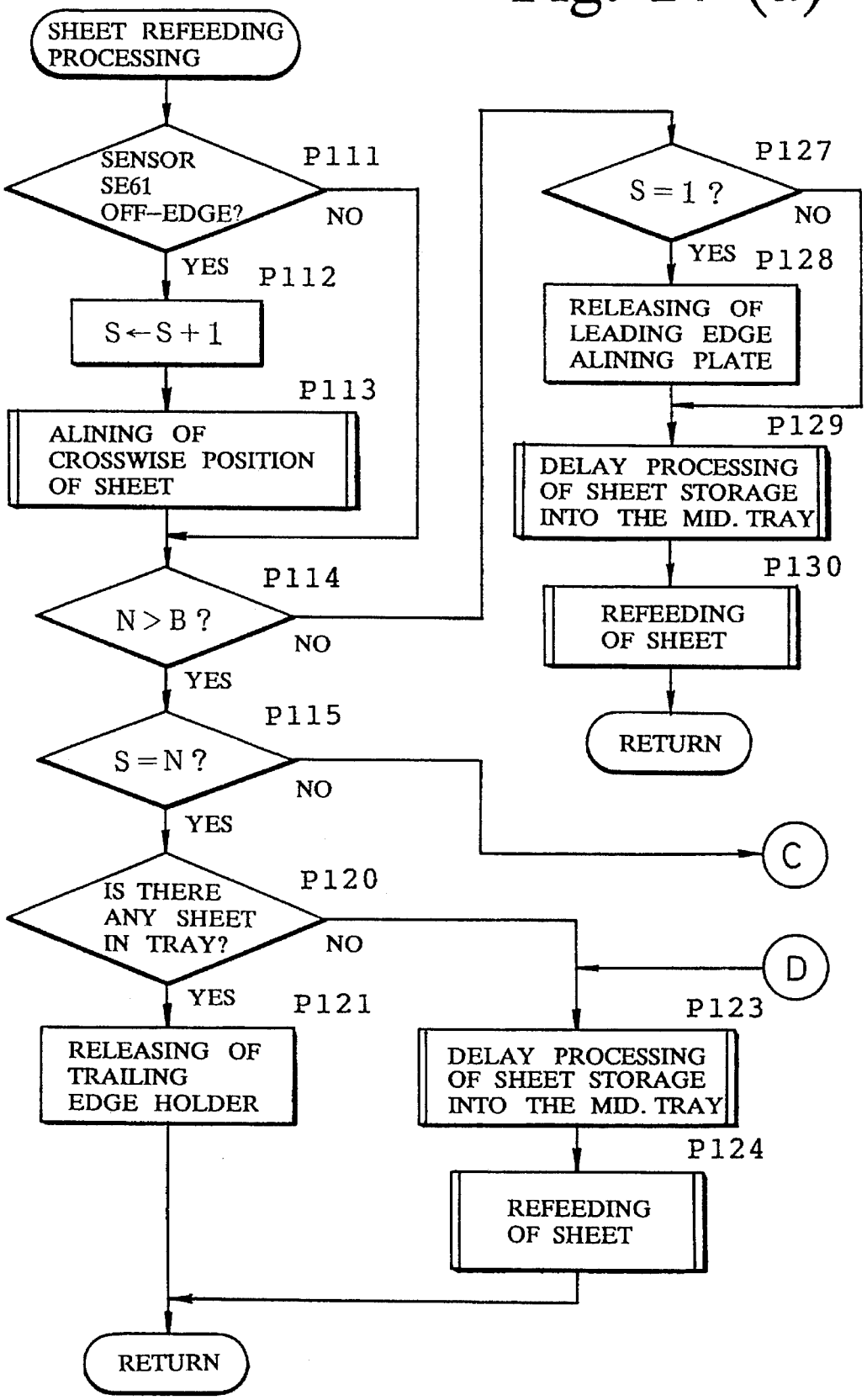
FIG. 14(*a*) and FIG. 14(*b*) are flowcharts detailing a sheet refeed process in the second embodiment.
Figure 14:
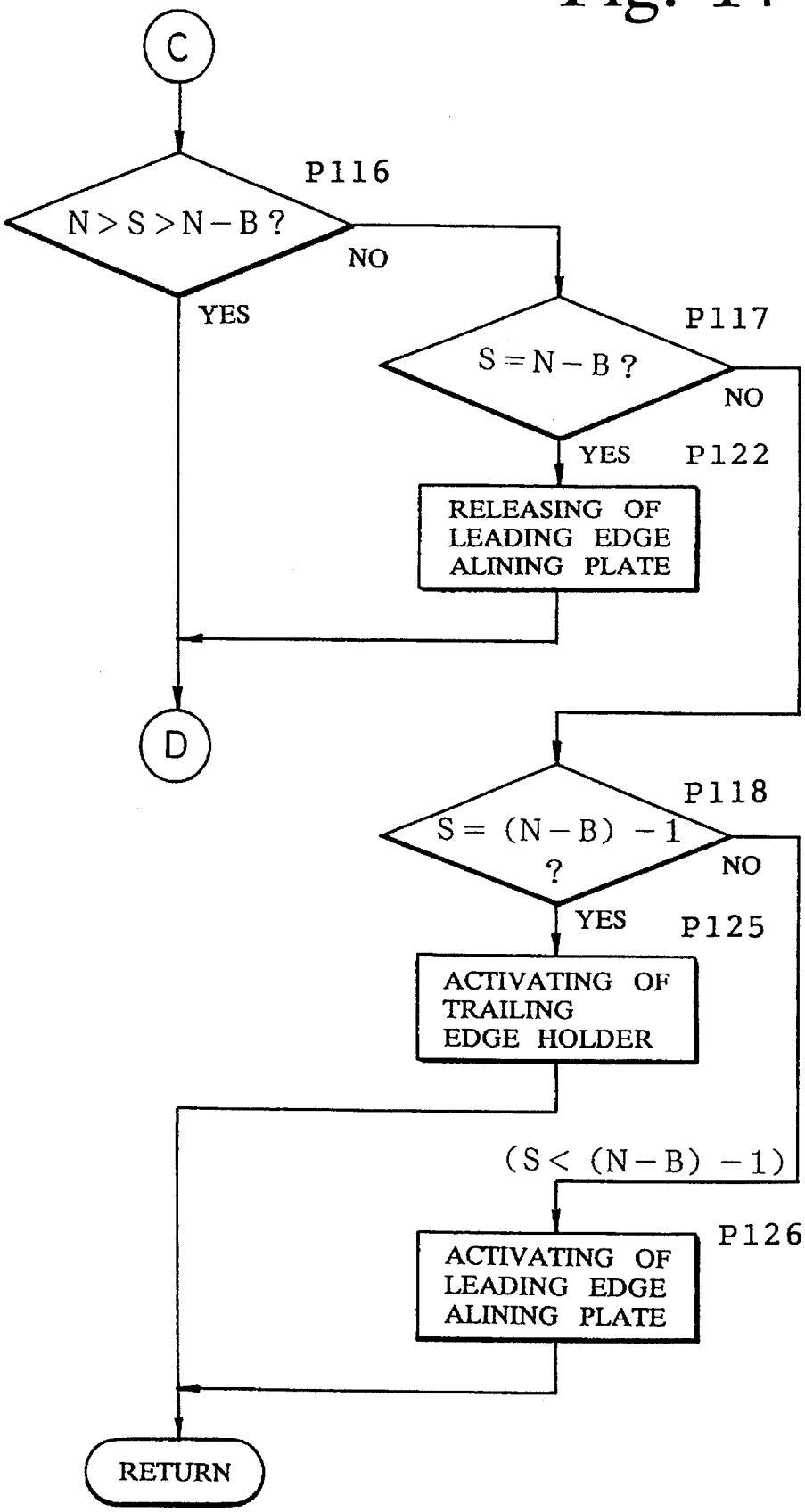
Figure 15:
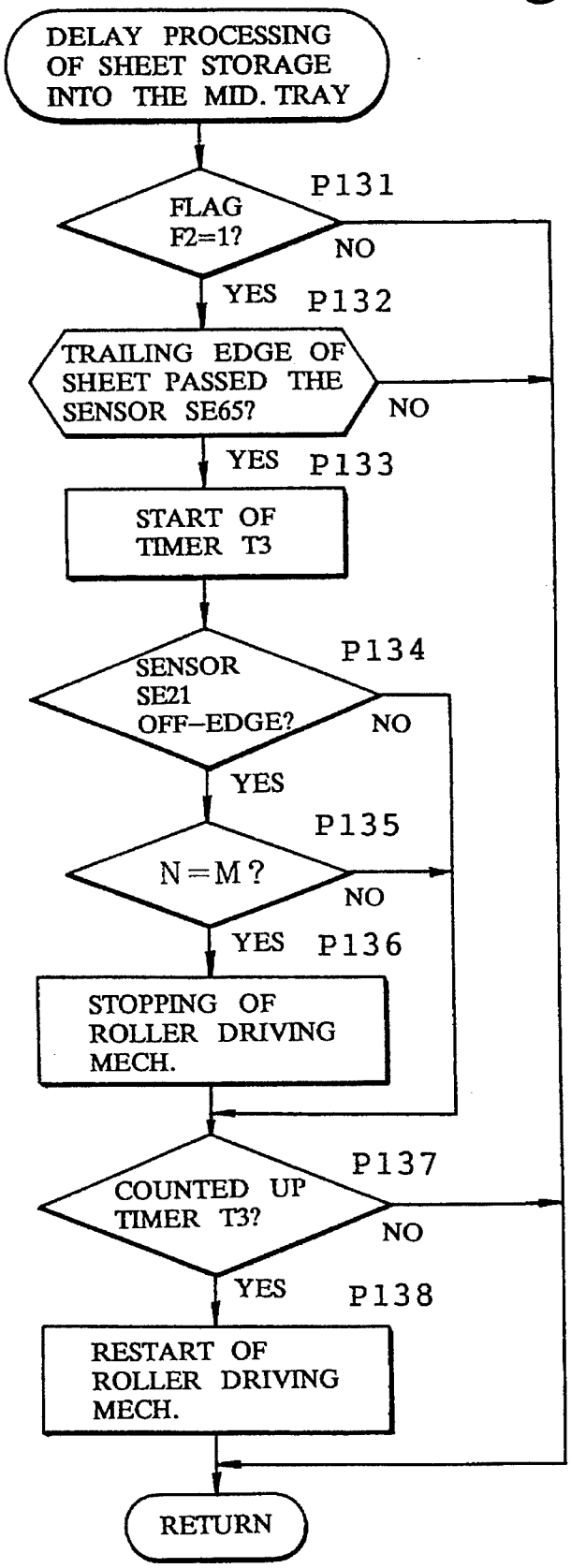
FIG. 15 is a flowchart detailing the process of delayed sheet storing into the intermediate tray in the second embodiment.

FIG. 14(*a*) and FIG. 14(*b*) are flowcharts detailing the sheet refeed process in step P106 of the routine in FIG. 13. These flowcharts are similar to that of the first embodiment as shown in FIG. 8(*a*) and FIG. 8(*b*). Below is a description of what makes the sheet refeed process of the second embodiment differ from that of the first embodiment.

In the first embodiment, the sheets already stored in the intermediate tray are not fed therefrom if $N>S>(N-A+1)$ in step P26 of the flowchart of FIG. 8(*a*) and FIG. 8(*b*). Instead, the sheet being transported anew to the intermediate tray part C is refed (step P33). If $S=(N-A+1)$ in step P27, the constraint exerted by the edge-aligning plate 76 on the sheets in the intermediate tray is released, and the sheet being transported anew to the intermediate tray part C is refed (step P33).

In the second embodiment, by contrast, the sheet refeed operation is preceded by a process of delaying sheet storage into the intermediate tray, whereby the sheet being transported to the intermediate tray part C is temporarily stopped midway. The process is constituted of steps P123 and P129 in the flowchart of FIG. 14(*a*). The other steps are essentially the same as those of the first embodiment. The value B in steps P114, P116, P117 and P118 in the second embodiment corresponds to the predetermined value A in the first embodiment.

The process of delaying sheet storage into the intermediate tray, shown as step P123 and step P129 in FIG. 14(*a*), will now be described in more detail with reference to the flowchart of FIG. 15.

A check is first made to see if the flag F2 set in step P104 of FIG. 13 is 1 to designate a temporary stop of the sheet being transported to the intermediate tray (step P131). If the flag F2 is found to have been set to 1, a check is made to see if the trailing edge of the (N–B)th sheet has passed the second storage sensor SE65 (step P132).

If the trailing edge of the sheet is found to have passed the second storage sensor SE65, a timer T3 is set to count the time for temporarily stopping the sheet midway in its transport path, and the counting is started (step P133).

A check is then made to see if the trailing edge of the sheet has passed the ejection preceding sensor SE21 (step P134). If the sheet is found to have passed the sensor SE21, a further check is made to see if as many sheets as the designated number N have been fed (i.e., if N=M) (step P135).

With the designated number of sheets having been fed (N=M), the driving of the mechanism ranging from the inversion rollers to the second storage rollers is stopped (step P136). Then an end is awaited of the counting by the timer T3 counting the time for temporarily stopping the sheet midway in its transport path (step P137). When the counting comes to an end, the driving of the inversion rollers through the second storage rollers is restarted (step P138). In this manner, each of the (N–B)th and subsequent sheets is temporarily stopped midway in its transport path so as to have an extended distance relative to the preceding sheet, before the intermediate tray part C is reached.

As described, even as sheets having copied the first document are still being stored into the storage means, the image forming apparatus of the invention starts operating the means for forming images of the second document by refeeding the sheets already stacked in the storage means. Because the image formation of the second document is started before that of the first document is finished, the inventive apparatus takes significantly less time to perform double-sided or overlay recording than conventional apparatuses.

Where the designated number of recording sheets exceeds a predetermined value, and the number of times the image forming means operates exceeds that value, the start of the subsequent operation of the image forming means is delayed by a predetermined time. That is, when the sheets having copied the first document are stored into the storage means, the refeed operation of the sheets already in the storage means is started in conjunction with the activation of the image forming means regarding the second document, with an extended transport distance provided between the sheet being stored into the storage means and the sheet being refed therefrom. Thus the interference between the sheets is prevented and any incidental dragged-along feed or jamming of sheets is eliminated.

Furthermore, the present invention is implemented without modifying the image forming velocity consisting of the rotating speed of the photosensitive drum and the transport rate of recording sheets. The appropriate control process of the image forming means need only be provided to implement the invention. Without any hardware additions requiring cost increases, the image forming apparatus of the invention performs image formation work such as double-sided and overlay recording more efficiently than before.

As many apparently different embodiments of this invention may be made without departing from the spirit and scope thereof, it is to be understood that the invention is not limited to the specific embodiments thereof except as defined in the appended claims.

What is claimed is:

1. An image forming apparatus comprising:

sheet feeding means for feeding sheets one by one;

image forming means for forming images on a sheet;

sheet storage means for temporarily storing the sheets with images formed thereon;

sheet refeeding means for refeeding to said image forming means the sheets stored temporarily in said sheet storage means;

sheet count setting means for setting a number of sheets on which images are formed; and control means used, if the number of sheets set by said sheet count setting means is larger than a predetermined value and when the number of times said image forming means operates has exceeded the predetermined value, for delaying by a predetermined delay time the start of the subsequent operation of said image forming means.

2. An image forming apparatus according to claim 1, wherein said sheet refeeding means starts refeeding a sheet after the last sheet set on said sheet count setting means has been fed by said sheet feeding means but before said last sheet reaches said sheet storage means.

3. An image forming apparatus according to claim 1, wherein said sheet storage means stores another sheet on the stacked ones.

4. An image forming apparatus according to claim 1, wherein said sheet refeeding means refeeds on a last-in, first-out basis the sheets stacked in said sheet storage means.

5. An image forming apparatus according to claim 1, wherein the delaying of the start of operation of said image forming means is accomplished by delaying the start of sheet feeding operation.

6. An image forming apparatus according to claim 1, wherein the delaying of the start of operation of said image forming means is accomplished by delaying the start of scanning operation by an optical scanning system.

7. An image forming apparatus according to claim 1, wherein the delaying of the start of operation of said image forming means is accomplished by delaying the start of operation of timing rollers.

8. An image forming apparatus according to claim 1, wherein the delaying of the start of operation of said image forming means is accomplished by delaying the timing of placing sheets into said sheet storage means.

9. An image forming apparatus comprising:

an image bearing member on which a toner image is formed;

a first sheet feeder which feeds sheets one by one to said image bearing member;

an intermediate tray in which sheets having images thereon are temporarily stored;

a second sheet feeder which refeeds to said image bearing member the sheets stored temporarily in said intermediate tray; and a controller which delays the start of the subsequent operation of said first sheet feeder by a predetermined time period when the number of sheets to be fed by said first feeder reaches a predetermined number.

10. An image forming apparatus according to claim 9, wherein said predetermined number is set based on the size of the sheets.

11. An image forming apparatus according to claim 9, wherein said predetermined number is set based on the recording magnification.

12. An image forming apparatus according to claim 9, wherein said second feeder feeds the top sheet stored in said intermediate tray.

* * * * *

UNITED STATES PATENT AND TRADEMARK OFFICE

CERTIFICATE OF CORRECTION

PATENT NO. : 5,485,261

DATED : January 16, 1996

INVENTOR(S) : Masayoshi Kuroda, et al.

It is certified that error appears in the above-indentified patent and that said Letters Patent is hereby corrected as shown below:

In Col. 10, line 22, change "(i.e., if $M \leqq N-B$)" to --(i.e., if $M \geqq N-B$)--.

In Col. 10, line 27, change "$M \leqq N-B$" to --$M \geqq N-B$--.

Signed and Sealed this

Sixteenth Day of April, 1996

Bruce Lehman

BRUCE LEHMAN

*Commissioner of Patents and Trademarks*

*Attest:*

*Attesting Officer*